US009879487B2

(12) United States Patent
Bell et al.

(10) Patent No.: US 9,879,487 B2
(45) Date of Patent: Jan. 30, 2018

(54) SANDLINE SPOOLING MEASUREMENT AND CONTROL SYSTEM

(71) Applicants: Brandon S. Bell, Cleburne, TX (US); David E. Lord, Midland, TX (US); Rodney W. Hollums, Midland, TX (US); Roger P. Burke, Midland, TX (US)

(72) Inventors: Brandon S. Bell, Cleburne, TX (US); David E. Lord, Midland, TX (US); Rodney W. Hollums, Midland, TX (US); Roger P. Burke, Midland, TX (US)

(73) Assignee: KEY ENERGY SERVICES, LLC, Houston, TX (US)

( * ) Notice: Subject to any disclaimer, the term of this patent is extended or adjusted under 35 U.S.C. 154(b) by 666 days.

(21) Appl. No.: 14/172,637

(22) Filed: Feb. 4, 2014

(65) Prior Publication Data

US 2014/0216735 A1 Aug. 7, 2014

Related U.S. Application Data

(60) Provisional application No. 61/760,552, filed on Feb. 4, 2013.

(51) Int. Cl.
*E21B 19/22* (2006.01)
*E21B 47/09* (2012.01)
(Continued)

(52) U.S. Cl.
CPC ..... *E21B 19/22* (2013.01); *E21B 7/02* (2013.01); *E21B 23/14* (2013.01); *E21B 47/09* (2013.01)

(58) Field of Classification Search
CPC . E21B 47/09; E21B 7/02; E21B 23/14; E21B 19/05; E21B 19/084; E21B 19/22; E21B 44/02
See application file for complete search history.

(56) References Cited

U.S. PATENT DOCUMENTS 4,156,467 A * 5/1979 Patton ..... E21B 45/00 173/21
4,334,217 A * 6/1982 Nield ..... G01B 7/042 175/45
(Continued)

OTHER PUBLICATIONS

Copenheaver, Blaine R., International Search Report and Written Opinion of the International Searching Authority for PCT/US2014/014692, dated May 12, 2014, pp. 1-9.

*Primary Examiner* — Brad Harcourt
(74) *Attorney, Agent, or Firm* — King & Spalding LLP

(57) ABSTRACT

Example embodiments of the present disclosure are directed to measurement and control systems and methods of improved spooling accuracy. Specifically, the systems and method disclosed herein provide techniques for accurately monitoring the depth of a sandline in a wellbore through sensing spool rotation, and controlling certain aspects of the spooling and/or producing certain notifications when the depth is above or below a certain threshold. Thus, the spool can be operated with increased diligence when it gets close to the wellhead. In certain example embodiments, the depth of the sandline is measured based at least partially on the number of spool rotations, compensating for decreasing length of sandline per layer of sandline on the spool.

19 Claims, 6 Drawing Sheets

(51) Int. Cl.
*E21B 23/14* (2006.01)
*E21B 7/02* (2006.01)

(56) References Cited

U.S. PATENT DOCUMENTS

| | | | | |
|---|---|---|---|---|
| 4,387,295 | A * | 6/1983 | Minichiello | E21B 45/00 173/21 |
| 7,518,526 | B2 | 4/2009 | Newman | |
| 2008/0037368 | A1* | 2/2008 | Newman | E21B 17/00 367/69 |
| 2011/0251803 | A1 | 10/2011 | Teurlay et al. | |
| 2012/0267466 | A1* | 10/2012 | Tracey | B65H 75/403 242/390.9 |

* cited by examiner

SANDLINE SPOOLING MEASUREMENT AND CONTROL SYSTEM

CROSS-REFERENCE TO RELATED APPLICATIONS

This application claims priority under 35 U.S.C. §119 to U.S. Provisional Patent Application No. 61/760,552, titled "SANDLINE SPOOLING MEASUREMENT AND CONTROL FOR OIL FIELD SERVICE UNITS," filed on Feb. 4, 2013, the entirety of which is incorporated by reference herein.

TECHNICAL FIELD

The embodiments described herein are generally directed to systems and methods for measuring and controlling the spooling and unspooling of a line from a spool. Specifically, exemplary embodiments of the present disclosure are directed to measuring and controlling the spooling and unspooling of a sandline in an oilfield servicing environment.

BACKGROUND OF THE INVENTION

A sandline is an example of a type of line that is commonly run into or out of wellbores in an oilfield services environment. A sandline is a cable that can be run into a wellbore. A sandline includes a tool attached to the down-hole end. The tool can be used for cleaning the wellbore, removing fluids or solids, or any other down-hole tool. In certain cases, the sandline and tool need to be pulled out of well or raised to the top of the well or wellhead. The sandline is wound on a spool and the tool is raised and lowered by winding and unwinding the sandline from the spool. There are often one or more piece of equipment coupled to the wellhead or above the wellhead, such as blowout preventers (BOP), lubricators, and the like. Generally, the sandline passed through the equipment. However, the tools are too big to fit through the equipment. When the sandline and tool are being pulled out of well, the tool can be pulled too far up and hit the equipment at the wellhead. Consequently, in such cases, the tool is separated from the sandline and is dropped to the bottom of the well. The tool and/or wellhead equipment may also be damaged when this happens. Other possible consequences include well fluids escaping into the environment and other rig damage. Currently, the depth and position of the sandline or sandline tool is monitored through rudimentary method and lack accuracy. For example, a common method of depth measurement is through manual control, in which a rig operator counts the layers of sandline on the spool, leaving large error margins and such an increased likelihood of incidence.

SUMMARY

These and other aspects, features and embodiments of the invention will become apparent to a person of ordinary skill in the art upon consideration of the following detailed description of illustrated embodiments exemplifying the best mode for carrying out the invention as presently perceived.

According to an aspect of the present disclosure, a spooling system includes a spool comprising a first spool end, a second spool end, and a spool body between the first spool end and the second spool end. The spooling system further includes a spool holder coupled to the spool, wherein at least a portion of the spool holder provides a rotational axis for the spool. The spooling system also includes a rotational detection system coupled to the spool, the spool holder, or both, wherein the rotational detection system detects rotation of the spool and outputs data regarding one or more rotational parameters of the spool.

According to an aspect of the present disclosure, a spooling control method includes detecting rotation of a spool, wherein the spool is coupled to a line. The line is further wound onto the spool when the spool rotates in a first direction and further unwound from the spool when the spool rotates in a second direction. The spooling method further includes generating a rotational data, and determining a length or position of an unwound portion of the line from the rotational data.

According to an aspect of the present disclosure, a spooling system includes a spool comprising a first spool end, a second spool end, and a spool body between the first spool end and the second spool end. The spooling system further includes a line comprising a first end and a second end, the first end coupled to the spool body and the second end coupled to a tool. The spooling system further includes a rotational detection system coupled to the spool, the spool holder, or both, wherein the rotational detection system detects rotation of the spool and outputs data regarding one or more rotational parameters of the spool.

BRIEF DESCRIPTION OF THE DRAWINGS

For a more complete understanding of the claimed invention and the advantages thereof, reference is now made to the following description, in conjunction with the accompanying figures briefly described as follows. In the drawings, reference numerals designate like or corresponding, but not necessarily identical, elements.

Figure 1:
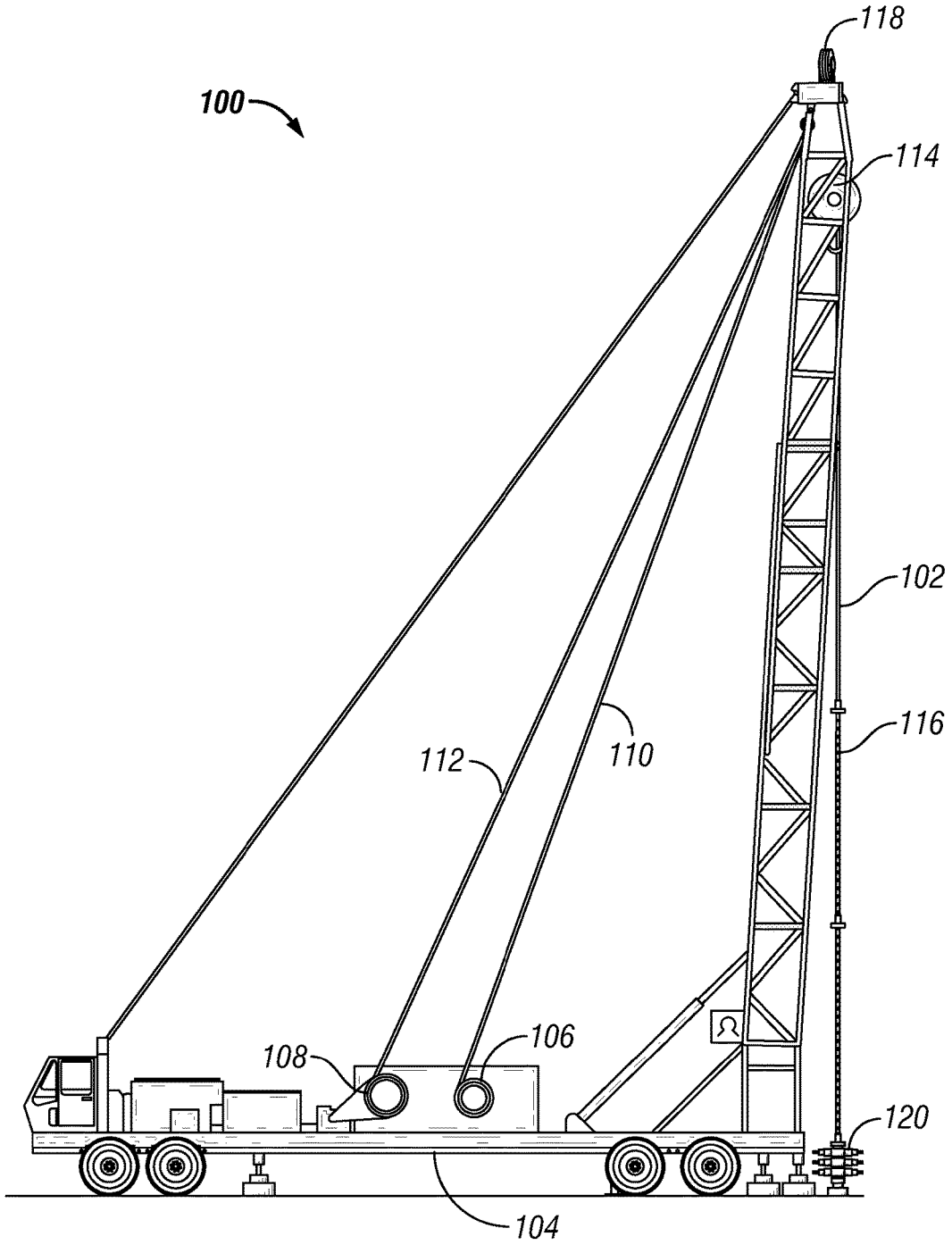
FIG. 1 illustrates an oilfield rig, in accordance with example embodiments of the present disclosure.

The drawings illustrate only example embodiments of methods, systems, and devices for measuring and controlling the spooling and unspooling of wire, and are therefore not to be considered limiting of its scope, emphasis instead being placed upon clearly illustrating the principles of the example embodiments. Such method, systems, and devices may admit to other equally effective embodiments that fall within the scope of the present disclosure. In the disclosure, certain devices and/or systems are described as carrying out certain functions of the present invention. However, other functionally interchangeable devices may substitute such example devices in carrying out an implementation of the present invention, and certain devices can be combined or one may be inclusive of another.

The methods shown in the drawings illustrate certain steps for carrying out the techniques of this disclosure. However, the methods may include more or less steps than explicitly illustrated in the example embodiments. Two or more of the illustrated steps may be combined into one step or performed in an alternate order. Moreover, one or more steps in the illustrated methods may be replaced by one or more equivalent steps known in the art to be interchangeable with the illustrated step(s). In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF THE EXAMPLE EMBODIMENTS

In the following detailed description of the example embodiments, numerous specific details are set forth in order to provide a more thorough understanding of the disclosure herein. However, it will be apparent to one of ordinary skill the art that the example embodiments herein may be practiced without these specific details. In other instances, well-known features have not been described in detail to avoid unnecessarily complicating the description Example embodiments of the present disclosure are directed to measurement and control systems and methods of improved spooling accuracy. Specifically, the systems and method disclosed herein provide techniques for accurately monitoring the depth of a sandline in a wellbore through sensing spool rotation, and controlling certain aspects of the spooling and/or producing certain notifications when the depth is above or below a certain threshold. Thus, the spool can be operated with increased diligence when it gets close to the wellhead. In certain example embodiments, the depth of the sandline is measured based at least partially on the number of spool rotations, compensating for decreasing length of sandline per layer of sandline on the spool. Thus, a more accurate position of the sandline tool can be determined. The terms wire, rope, line, and sandline are used interchangeably in the present disclosure and are representative of a class of lines compatible for use with the techniques provided herein.

Turning to the figures, FIG. 1 illustrates an oilfield rig 100, in accordance with example embodiments of the present disclosure. In certain example embodiments, the rig 100 includes a mast 102 and a carrier 104. The illustrated carrier 104 is a transport vehicle. In certain other embodiments, the carrier 104 is a skid or trailer. During operation, the mast 102 extends up from the carrier 104, which is generally positioned next to a well. The mast 102 supports the suspension of various down-hole tools over well center and into the wellbore. In certain example embodiments, the carrier 104 and base of the mast 102 are positioned next to a well, and the mast 102 extends upward at an angle towards the well such that the top 118 of the mast 102 is over the well. Thus, tools suspended from the mast 102 are directed over the well and can be lowered into the wellbore. Various tools can be suspended from the mast 102. Specifically, in certain example embodiments, a travelling block 114 travels up and down the mast 102 to raise and lower a tube or pipe string.

In certain example embodiments, the rig also includes a tubing drum 106 and a sandline drum 108. The tubing drum 106 includes a tubing line 110, and the sandline drum 108 houses a spool of sandline wire 112. The sandline wire 112 is a wire rope which extends from the sandline drum 108 to the top 118 of the mast 102 and down the front of the mast 102, and into the wellbore. In certain example embodiments, one or more sandline tools are attached to the end of the sandline wire 112 and are suspended down-hole via the sandline wire 112 and the mast 102. As the sandline wire 112 is suspended from the top 118 of the mast 102, the sandline wire 112 and sandline tools are aligned with the wellbore. As the sandline drum 108 unspools or unwinds more sandline wire 112, the sandline tools are lowered further down-hole. Conversely, as the sandline drum 108 spools or winds more sandline cable 112, the sandline tools are lifted upward. In certain example embodiments, the sandline tools include tools for removing fluid and/or solids from the wellbore, cleaning the wellbore, or a variety of other functions. In certain example embodiments, a sinker bar is attached to the end of the sandline cable 112 and is used to check the depth of the well.

In certain example embodiments, the well is topped with a blowout preventer (BOP) 120 and/or a lubricator 116. In certain example embodiments, the sandline wire 112 is disposed through the BOP 120 and/or the lubricator 116 with the sandline tools downhole below the BOP 120 and/or the lubricator 116. Thus, as the sandline wire 112 is spooled and the sandline tools are raised, it is advantageous to slow down the spooling of the sandline wire 112 when the sandline tools get close to the surface, decreasing the likelihood of the sandline tools hitting parts of the BOP 120 or lubricator 116. In certain example embodiments, spooling of the sandline wire 112 is slowed as the sandline tools reach the top of the mast 118 to prevent the sandline tools from hitting the mast 102. The present disclosure provides systems and methods for measuring the distance, speed, and location of the sandline tools such that it can be detected when the sandline tools pass a threshold point, such as being within a certain distance from equipment such as the BOP 120, the lubricator 116, the mast 102, and the like. Furthermore, in certain example embodiments, the system controls the spooling or unspooling of the sandline wire 112 depending on the measured location of the sandline tools or the distance of the sandline wire 112. In certain example embodiments, such measurements are made with an instrumented sandline spool 200.

Figure 2:
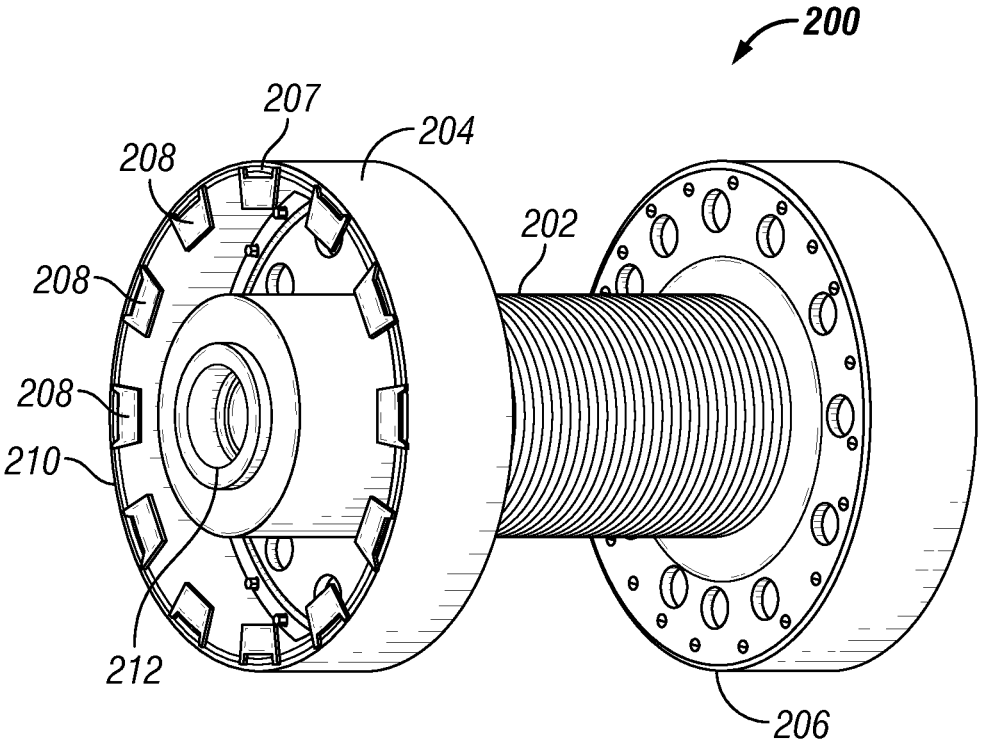
FIG. 2 illustrates an instrumented spool, in accordance with example embodiments of the present disclosure.

FIG. 2 illustrates the instrumented spool 200, in accordance with example embodiments of the present disclosure. The spool 200 includes a spool body 202, a first flange body 204, and a second flange body 206. The first and second flange bodies 204, 206 are coupled to and flank the spool body 202. The sandline wire 112 is wound around the spool body 202 and kept on the spool body 202 by the first and second flange bodies 204, 206. In certain example embodiments, the flange bodies 204, 206 are cylindrically shaped and concentric with the spool body 202, and have a diameter greater than the diameter of the spool body 202. In certain example embodiments, the first and second flange bodies 204, 206 include a central extension 210, which includes a cavity 212 through which an axle (not shown) can be disposed. The cavity 212 is concentric with the cylindrical spool body 202 such that the spool body 202 rotates about the axle. In certain example embodiments, at least the first flange body 204 includes an outer perimeter 207 also concentric with the spool body 202.

The spool 200 is instrumented with rotational detection devices. In certain example embodiments, the spool 200 is instrumented with an inductive proximity detection system. Specifically, in certain example such embodiments, the perimeter 207 of the first flange body 204 is instrumented with one or more targets 208. In certain example embodiments, the targets 208 are fixed to the flange body 204 or spool 200 in areas other than the perimeter 207. In certain example embodiments, the targets 208 are evenly spaced around the perimeter 207, and the number of targets 208 fixed to the perimeter 207 is selected in accordance with the size or diameter of the perimeter 207. In certain example embodiments, the targets 208 are made of metal. The targets 208 are fabricated from a metal material appropriate for detection by a sensor module 300.

Figure 3:
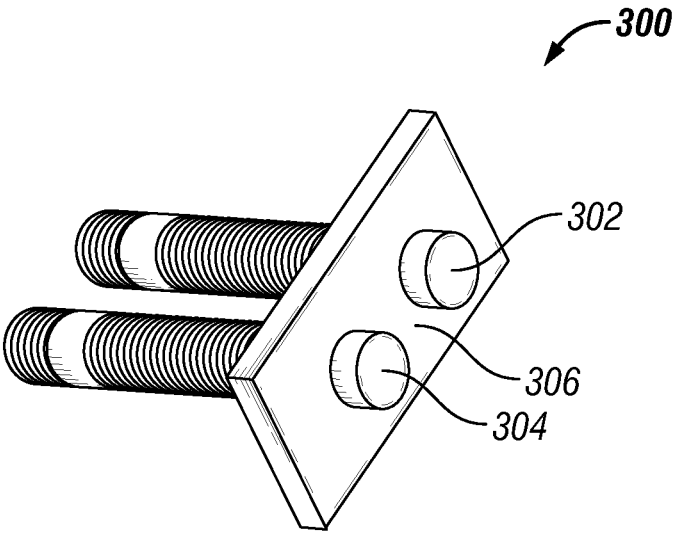
FIG. 3 illustrates a rotational sensor, in accordance with example embodiments of the present disclosure.

FIG. 3 illustrates the sensor module 300, in accordance with example embodiments of the present disclosure. In certain example embodiments, the sensor module 300 includes a first inductive proximity sensor 302 and a second inductive proximity sensor 304. In certain example embodiments, the first and second inductive proximity sensors 302, 304 are threaded onto a mounting bracket 306. The sensor module 300 is configured to detect when a metal target comes into a sensing area and exits the sensing area. Specifically, in certain example embodiments, each of the first and second inductive proximity sensors 302, 304 consists of a coil and ferrite core arrangement, and oscillator and detector circuit. The oscillator generates a high frequency field radiating from the coil in front of the inductive proximity sensor 302, 304. When one of the metal targets 208 enters the high frequency field, eddy currents are induced on the surface of the target 208. This results in a loss of energy in the oscillator circuit and, consequently, a smaller amplitude of oscillation. The detector circuit recognizes a specific change in amplitude and generates a signal indicative of the target 208 being within the sensing area. When the target 208 rotates out of the sensing area, the amplitude of oscillation increases, and the detector circuit recognizes that the target 208 is out of the sensing area. Thus, each of the first and second inductive proximity sensors 302, 304 detects the targets 208 as they rotated in and out of the respective sensing areas. Each detection of a target 208 is known as a count. As the number of targets 208 on the spool 200 is known, it can be determined from the inductive proximity sensors 302, 304 when a full revolution of the spool 200 occurs. In certain example embodiments, data from the first and second sensors 302, 304 is used to determine the amount of rotation as well as the speed and direction of rotation based on which of the two inductive proximity sensors 302, 304 senses a target 208 first. In certain example embodiment, a positive count indicates rotation in a first direction and a negative count indicates rotation in the opposite direction.

Figure 4:
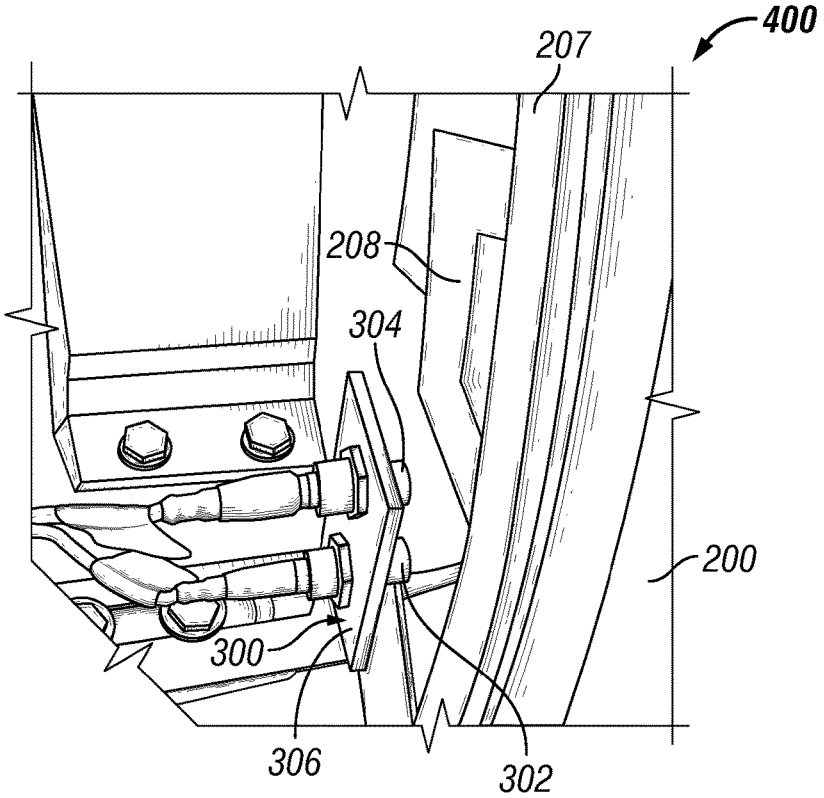
FIG. 4 illustrates an assembly of the instrumented spool and the rotational sensor of FIGS. 2 and 3, respectively, in accordance with example embodiments of the present disclosure.

FIG. 4 illustrates an assembly 400 of the instrumented spool 200 and the rotational sensor of FIGS. 2 and 3, respectively, in accordance with example embodiments of the present disclosure. Specifically, FIG. 4 illustrates one of the targets 208 fixed to the perimeter 207 of the spool 200 and the inductive proximity sensor 300 mounted to a housing or spool drum via the mounting bracket 306. In certain example embodiments, the sensor module 300 is mounted in a fixed position with respect to the housing or spool drum. The sensor module 300 is disposed across from and facing the target 208 at a certain distance, such that as the spool 200 rotates, each of the targets 208 passes directly in front of the sensor module 300. The sensor module 300 detects each target 208 as it enters and exits the sensing areas, thereby detecting rotation of the spool 200. Thus, the sensor module 300 can provide accurate data regarding rotation of the spool 200, such as the number of rotations, and the speed and direction of the rotations. In certain example embodiments, the instrumented spool 200 and sensor module 300 are coupled to or housed within the sandline drum 108 or an alternative housing on the oilfield servicing rig 100. In certain example embodiments, the oilfield servicing rig 100 comprises the instrumented spool 200 and sensor module 300.

Figure 5:
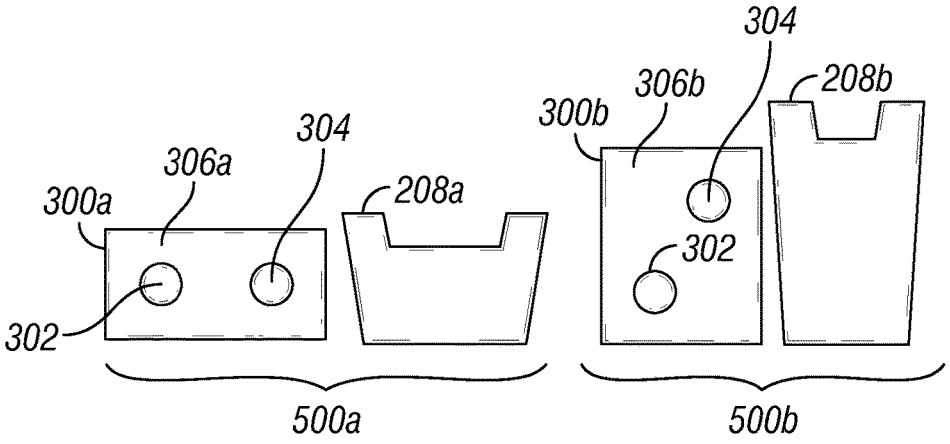
FIG. 5 illustrates two target and sensor configurations, in accordance with example embodiments of the present disclosure.

In certain example embodiments, the targets 208 and the sensor module 300 have compatible configurations or shapes. FIG. 5 illustrates two example target and sensor configurations, in accordance with example embodiments of the present disclosure. Specifically, a first target and sensor set 500*a* includes a first sensor 300*a* having first and second inductive proximity sensors 302, 304 arranged on a first mounting bracket 306*a* in a configuration that spans across a substantial area of a first target 208*a*. Likewise, a second target and sensor set 500*b* includes a second sensor 300*b* having first and second inductive proximity sensors 302, 304 arranged on a second mounting bracket 306*b* in a configuration that spans across a substantial area of a second target 208*b*. In certain example embodiments, the first and second inductive proximity sensors 302, 304 are calibrated for distance in order to accurately detect the passing targets 208. In certain example embodiments, the targets are other geometric or non-geometric shapes than those shown as examples herein. In certain example embodiments, the mounting brackets 306 have other geometric or non-geometric shapes than those shown as examples herein. In certain example embodiments, the mounting bracket 306 is replaced by another holder or mounting device for holding the first and second inductive proximity sensors 302, 304 in position relative to the targets 208.

In certain example embodiments, the instrumented spool 200 includes other rotational detection devices rather than the example inductive proximity system discussed above. For example, in certain embodiments, the spool 200 includes an encoder-based rotational detection device. Specifically, in certain such embodiments, the spool 200 includes an optical encoder or a magnetic encoder. In another example embodiment, the spool 200 includes a hall effect rotational detection device. In certain example embodiments, the rotation detection device produces a quadrature signal as an output, from which rotational data, such as the amount, direction, and speed of revolution, can be derived. In certain example embodiments, different portions of the spool 200 or spool drum 108 can be instrumented with various sensors to generate rotational data.

Figure 6:
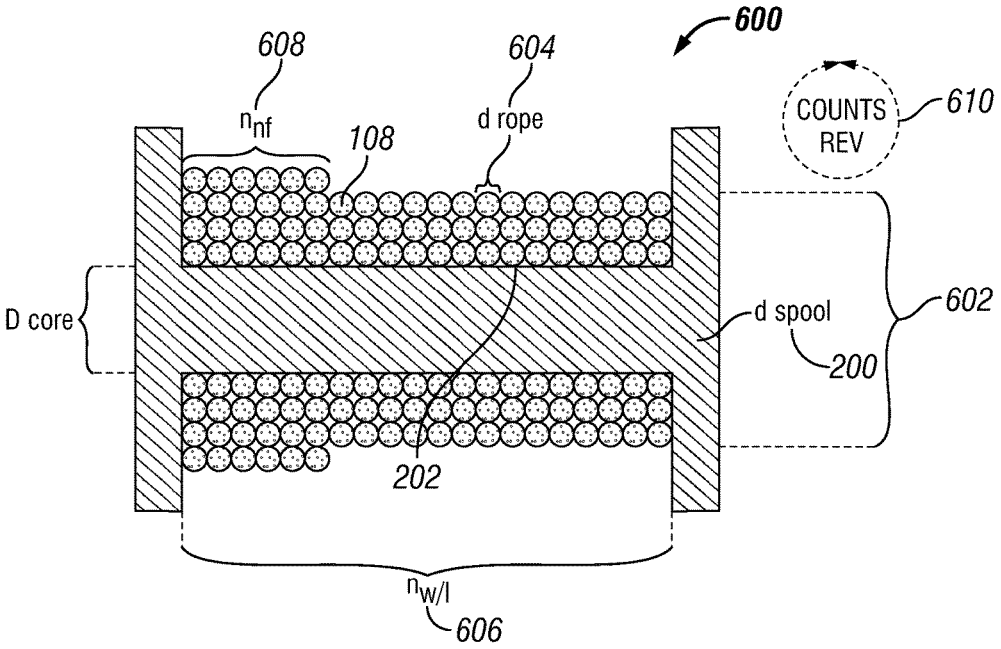
FIG. 6 illustrates a cross-sectional representation of a sandline spool wrapped with sandline wire, in accordance with example embodiments of the present disclosure.

In order to obtain data regarding the depth or extended length of the sandline, the rotational data collected by the rotational detection device is translated into depth data. Specifically, in order to do so, in certain example embodiments, a mathematical relationship between the number of revolutions of the spool 200 and the depth of the sandline 112 is derived. FIG. 6 illustrates a cross-sectional representation 600 of a sandline spool 200 wrapped with sandline cable 112, in accordance with example embodiments of the present disclosure. The relationship between the number of revolutions of the spool 200 and the depth of the sandline 112 depends at least partially on several parameters, including the following:

$d_{spool}$ (602)=diameter of the spool with rope $d_{rope}$ (604)=diameter of the rope strand $n_{w./l}$ (606)=wraps per layer $n_{nf}$ (608)=total wraps beyond last full layer $counts_{rev}$=number of spool revolutions counts=number of sensor/target counts In certain example embodiments, such as those with multiple targets 208 disposed around the spool 200, the "counts" parameter refers to number of times a target is sensed, and the "$counts_{rev}$" is determined by dividing the "counts" value by the total number of targets 208 on the spool.

Given these parameters, the depth of the sandline can be determined from the following equations:

$$\text{depth} = \sum_{i=0}^{n_{fw}} [2\pi(r_{outer} - d_{rope}i)] + 2\pi(r_{outer} - d_{rope}(n_{f_w} + 1)) + 2\pi(r_{outer} + d_{rope})(n_{pw} - n_{wl}n_{fw})$$

$$n_{fw} = \left\lceil \frac{n_{pw}}{n_{wl}} \right\rceil$$

$$n_{pw} = \frac{\text{counts}}{counts_{rev}} - \min\left\{\frac{\text{counts}}{counts_{rev}}, n_{aw}\right\}$$

$$r_{outer} = \frac{d_{spool} - d_{rope}}{2}$$

By applying these algorithms, the depth of the sandline can be plotted against the number of revolutions of the spool. The depth algorithm takes into consideration layer compensation, in which the length of the sandline per layer on the spool 200 decreases as the layer comes closer to the spool body 202. Thus, the depth to revolution relationship determined through the depth algorithm above provides a more accurate measurement of the depth of the sandline 108.

Figure 7:
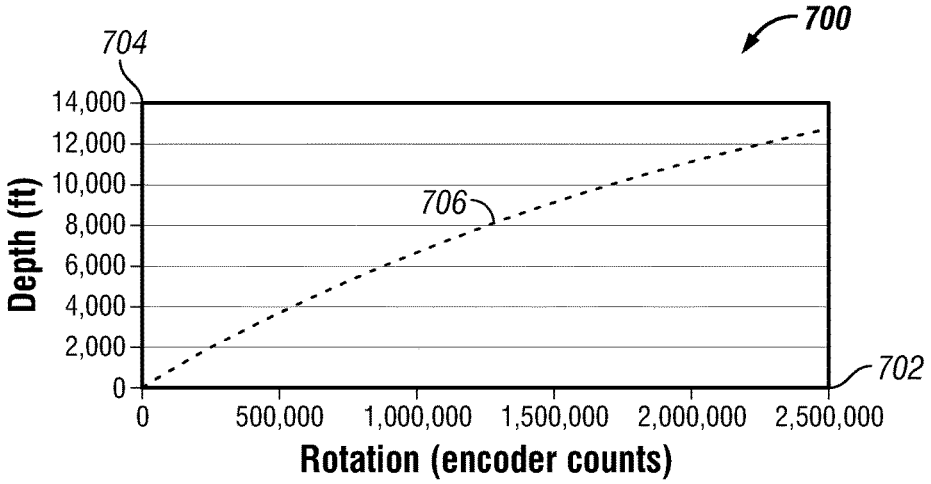
FIG. 7 is a graph illustrating the relationship between drum rotation and wire depth, in accordance with example embodiments of the present disclosure.

FIG. 7 is a graph 700 illustrating a relationship between sandline depth and number of revolutions of the spool 200, in accordance with example embodiments of the present disclosure. The graph 700 includes the rotations 702 of the spool as the x-axis and the depth 704 of the sandline as the y-axis, and a curve 706 illustrating the relationship between the number of rotations 702 and the depth 704 of the sandline. In certain example embodiments, such as that illustrated in FIG. 7, the number of rotations 702 is expressed as a number of target counts. Target counts is the number of targets 208 that pass in front of the sensor module 300. In certain example embodiments, the number of rotations 702 is derived from the measured target counts and using the dimensional parameters of the spool 600. In certain example embodiments, the graph 700 is plotted deriving the depth algorithm above. In certain example embodiments, and as shown in the graph 700, the relationship between depth 704 and number of revolutions 702 is not linear. Rather, the increase in depth 704 of the sandline 112 decreases as the number of revolutions 702 increases. In certain example embodiments, the number of revolutions 702. In certain example embodiments, the number of revolutions 702 is derived from the number of sensor counts. For example, referring to FIGS. 2 and 4, the number of revolutions 702 is determined by dividing the number of times a target 208 passes in front of the sensor 300 by the total number of targets 208 on the spool 200. The curve 706 or relationship between depth 704 and number of revolutions 702 is different for each unique spool or sandline embodiment. Thus, a unique curve is generated for each spool or sandline embodiment.

In certain example embodiments, after the curve 706 is derived and plotted from the depth algorithm, a simplified relationship between the depth 704 and the number of revolutions 702 is determined. In certain example embodiments, the simplified relationship is a quadratic equation having the form $ax^2+bx+c$, in which parameter a, b, and c are derived from the depth algorithm. In certain example embodiments, the simplified relationship is determined by applying a best-fit curve analysis to the curve 706 derived from the depth equation. In certain example embodiments, once the simplified relationship is derived, it can be used to determine the depth of the sandline from the number of revolutions of the spool using less computational resources and time. Thus, as the sandline 112 is being run into or out of hole, the depth of the sandline can be accurately monitored in real time. In certain example embodiments, the direction and velocity of the sandline can also be measured based on the disparity between the first and second inductive proximity sensors 302, 304.

In certain example embodiments, the measured depth of the sandline is used to determine and execute a number of control commands. For example, in certain embodiments, in a running out of hole sandline operation, when the measured depth of the sandline is determined to be less than a threshold value, a number of notification outputs or controls can occur. In certain example embodiments, the notification outputs include a visual indication, an audible indication, a message or indication delivered to a remote device, or any combination of these. In certain example embodiments, the controls include slowing down the running speed of the sandline, disabling the user-controls in favor of automated controls, limiting the running speed, stopping the running of the sandline, or any other desired or preprogrammed control scheme. Such notifications and controls allow for increased diligence in lifting the sandline and sandline tools to the top of the well or out of the well.

Figure 8:
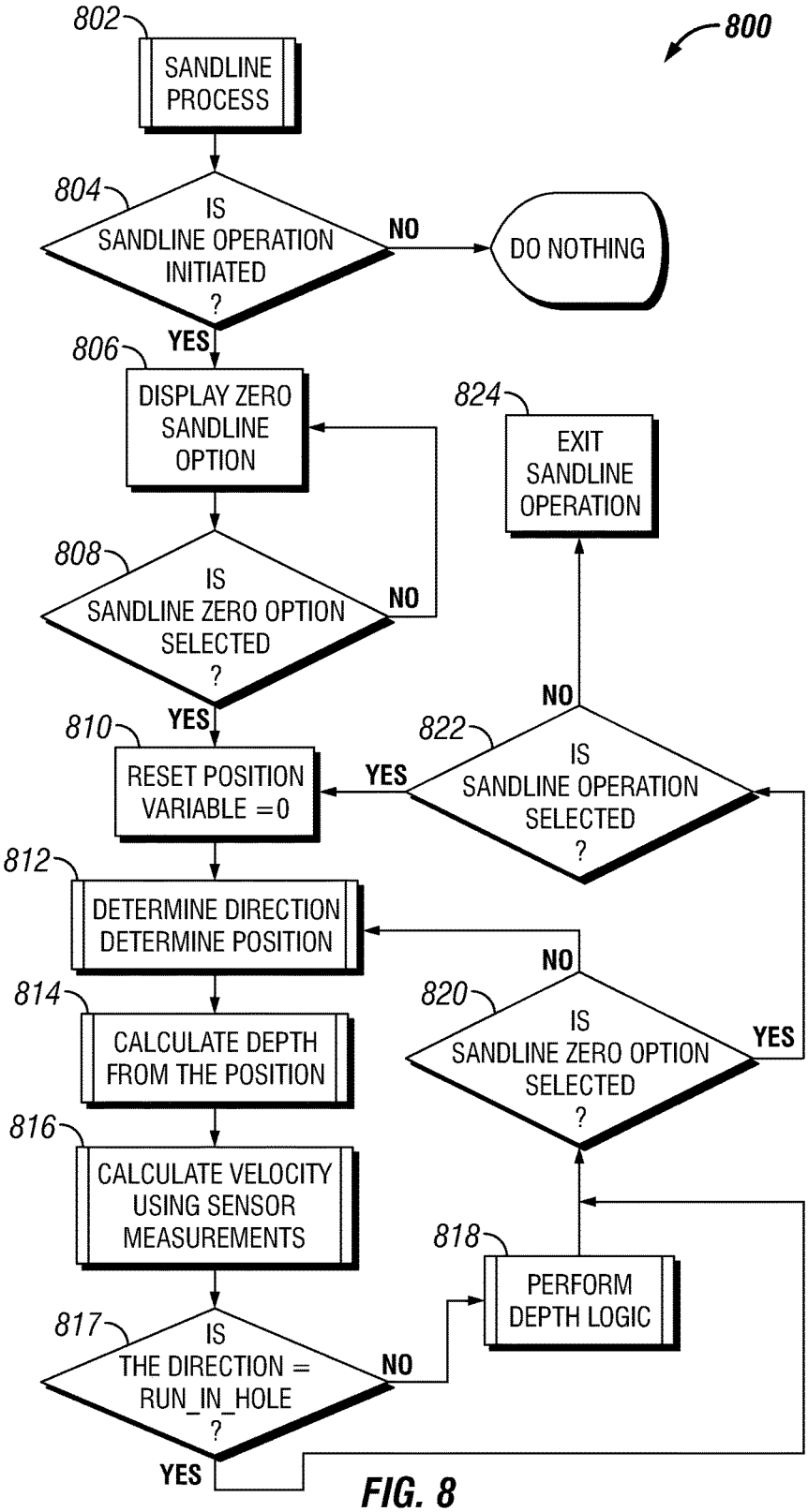
FIG. 8 illustrates a sandline operation process, in accordance with example embodiments of the present disclosure.

FIG. 8 illustrates a sandline operation process 800 using the instrumented spool 200 and the derived depth data, in accordance with example embodiments of the present disclosure. In certain example embodiments, the sandline process 802 begins by determining if the sandline operation has been initiated (step 804). In certain example embodiments, determining if the sandline operation has been initiated (step 804) includes determining if a sandline operation button or switch has been actuated. If the sandline operation has not been initiated, then no other actions are taken. If the sandline operation has been initiated, then a zero sandline option is displayed (step 806). In certain example embodiment, a dynamic display screen or touch screen displays a zero sandline button or selection when the sandline operation is initiated. In certain example embodiments, the zero sandline option is a physical button. After the sandline operation is initiated and the zero sandline option is displayed, it is then determined if the sandline zero option is selected (step 808). If the sandline zero option is selected, then a position or length value is set to zero (step 810). This is known as the 0 position or the origin position. In other words, the origin position is known and any change in position will be relative to the origin position. In certain example embodiments, the direction and position of the sandline or tool can be determined by visual inspection, alternate indication, actual measurement, last calculated position, or other determinative method. Thus, the system is calibrated by correlating the determined position and direction as the origin or 0 position. In certain example embodiments, the direction and position of the sandline or tool is determined (812). In certain example embodiments, the depth of the sandline is calculated from the position (step 814). The velocity of the sandline is calculated using data from the rotational detection device (step 816). In certain example embodiments, parameters such as the abovementioned direction, position, depth, and velocity, are measured or derived from the outputs of the rotational detection device. In one example embodiment, in which the rotational detection device includes the inductive proximity sensor module 300 and targets 208, the parameters are measured or derived from the target counts.

In certain example embodiments, it is determined if the current sandline operation is a running into hole operation (step 817). If it is not a running into hole operation, meaning it is a running out of hole operation, then depth control logic is performed (Step 818). Depth control logic is performed based on the abovementioned calculated and measured parameters and continuously checking them against threshold values. The depth control logic process, which produces notifications or control signals based on these parameters, is further detailed in FIG. 9. Referring still to FIG. 8, after performing the depth control logic, it is again determined if the sandline zero option is selected (step 820), meaning that current position of the sandline is set at the zero reference point. If the sandline zero option is not selected, then the current direction and position of the sandline is determined (step 812), the depth of the sandline is calculated (step 814), the velocity is calculated (step 816), and depth logic is performed (816) again. This loop is performed continuously and the data is logged until it is determined that the sandline zero option is selected. When the sandline zero option is selected, then it is determined if the sandline operation is still selected (step 822). If the sandline operation is no longer selected (e.g., the sandline operation is turned off), then the sandline operation ends (step 824). Alternatively, if the sandline zero option is selected and the sandline operation is still selected, then the position variable is reset to 0 again, and data continues to be logged until the sandline operation is no longer selected. In certain example embodiments, the calculation and measurement steps 812, 814, 816, and 818 are performed in different order, together in various combinations, or separated into further steps. In certain example embodiment, selection of sandline operation or the sandline zero option is performed by a user via a wired or wireless input device or interface or automatically as a part of a set of automated instructions.

Figure 9:
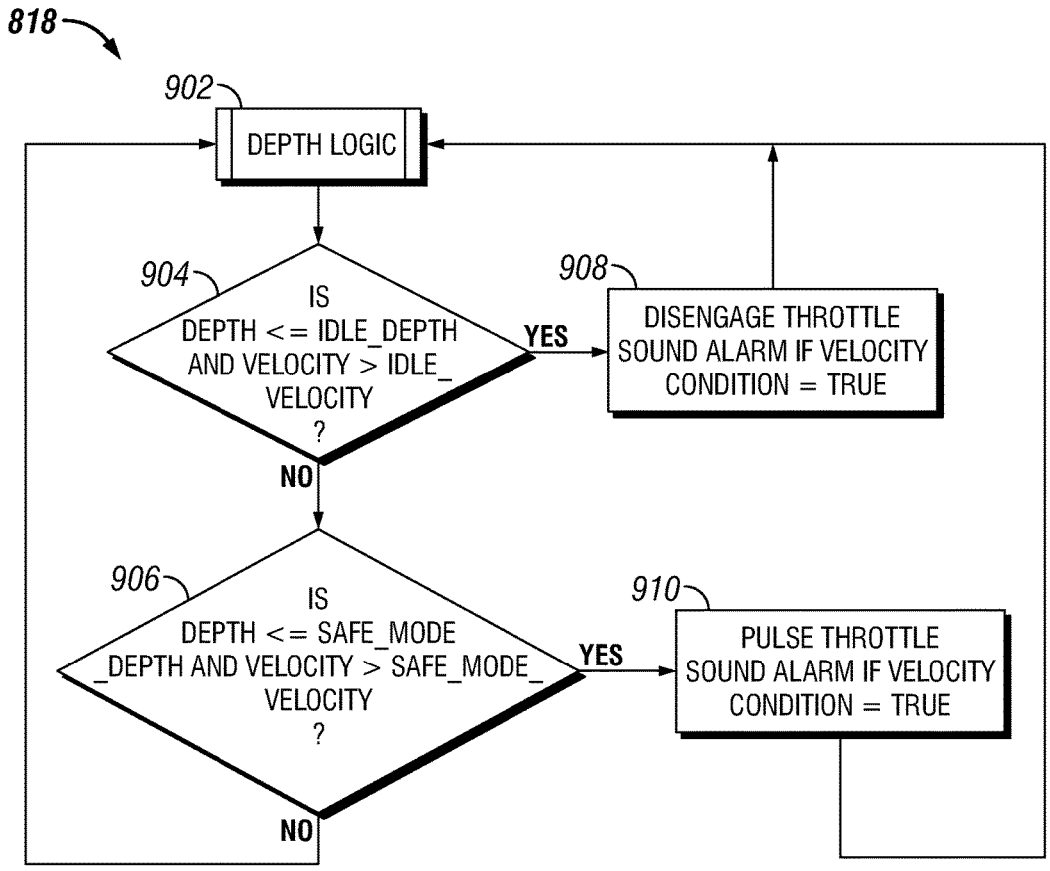
FIG. 9 illustrates a depth logic and control process, in accordance with example embodiments of the present disclosure.

FIG. 9 illustrates a detailed method of carrying out the depth logic step 818 of FIG. 8, in accordance with example embodiments of the present disclosure. Referring to steps 8 and 9, in certain example embodiments, a depth logic cycle 902 begins by determining if the depth calculated in step 814 is less than or equal to an idle_depth threshold value and if the velocity calculated in step 816 is greater than an idle_velocity threshold value (step 904). If both of these conditions are met, then the throttle of the spool is disengaged or put into an idle mode (step 908). When the throttle is disengaged, the spool rotation slows. In certain example embodiments, an alarm also sounds when the velocity condition is met. Alternatively, if either of these conditions are not met, then the system determines if the depth is less than or equal to a safe_mode_depth threshold value and if the velocity is greater than a safe_mode velocity threshold value. If both of these conditions are met, then the throttle pulsed (step 910). In certain example embodiment, an alarm sounds if the velocity condition is met. Is either of these conditions are not met, the depth logic cycle starts over at step 902. In certain example embodiments, an idle depth, as referred to in step 904, is a distance of the wellbore closest to the wellhead. A safe mode depth, as referred to in step 906, is a distance of the wellbore adjacent to but deeper than the idle depth portion. Thus, during a running out of hole operation, the sandline may enter the safe mode depth portion and cause pulsing of the throttle (step 910) until the sandline enters the idle depth portion. In certain example embodiments, the depth logic cycle 902 runs continuously when the sandline operation is on and continuously monitors for the conditions of steps 904 and 906 to be met and produces control or notification signals or outputs (steps 908 and 910) when appropriate. In certain example embodiments, different conditions or different combination of conditions are set to bring about the outputs of steps 908 and 910. Furthermore, the outputs of steps 908 and 910 can take different forms. For example, in certain other example embodiments, the outputs include stopping rotation of the spool, limiting the velocity of rotation, disengaging user controls, producing a flashing light, sending a message, the like, or any combination thereof. The depth logic cycle 902 of FIG. 9 is an embodiment designed for a running out of hole sandline operation, in which increased diligence is desired as the sandline or sandline tool gets closer to the wellhead. Thus, the depth is detected for being less than certain threshold values. Alternatively, in a running into hole sandline operation, the conditions of the depth logic cycle 902 may be different. For example, the depth may be detected for being greater than certain threshold values in order to provide increased diligence as the sandline or sandline tool gets closer to the well bottom.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the example embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

We claim:

1. A spooling system, comprising:

a spool comprising a first spool end, a second spool end, and a spool body between the first spool end and the second spool end;

a spool holder coupled to the spool, wherein at least a portion of the spool holder provides a rotational axis for the spool;

a cable at least partially wound around the spool body, the cable being further wound around the spool body when the spool rotates in a first direction and the cable being further unwound from the spool body when the spool rotates in a second direction; and a rotational detection system coupled to the spool, the spool holder, or both, wherein the rotational detection system detects rotation of the spool and outputs data indicative of one or more rotational parameters of the spool comprising at least the number of spool rotations, wherein the rotational detection system comprises a sensor module and one or more sensing targets, the sensor module being disposed across from and facing the one or more sensing targets at a certain distance, the one or more sensing targets being disposed at even intervals around a perimeter of the first spool end and extending from the perimeter of the first spool end inwardly towards the rotational axis, wherein the one or more sensing targets pass in front of the sensor module when the spool rotates, wherein the unwound portion of the cable is measured only with data from the rotational detection system and is based at least partially on the number of spool rotations, the diameter of the spool, the diameter of the cable, the number of wraps per layer of cable on the spool, and the number of wraps beyond the last full layer of cable, thereby compensating for decreasing length of cable per layer of cable on the spool.

2. The spooling system of claim 1, wherein the cable comprises a first end and a second end, wherein the first end is coupled to the spool and the second end is coupled to a tool, wherein the tool is lifted when the spool rotates in the first direction; and wherein the tool is lowered when the spool rotates in the second direction.

3. The spooling system of claim 2, further comprising a controller, wherein the controller receives a signal from the rotational detection system indicative of the one or more rotational parameters of the spool and determines a position or distance of the tool based on the one or more rotational parameters of the spool.

4. The spooling system of claim 3, wherein the controller outputs a notification signal or control command when the position or distance of the tool passes a depth threshold value and/or when a detected velocity of the spool is above or below a velocity threshold value.

5. The spooling system of claim 1, wherein the rotational detection system comprises an inductive proximity sensing system, the inductive proximity sensing system further comprising the sensor module and the one or more sensing targets.

6. The spooling system of claim 5, wherein the inductive proximity sensor module comprises a first inductive proximity sensor and a second inductive proximity sensor.

7. A spooling control method of a well service rig, comprising:

detecting rotation of a spool on a well service rig, wherein the spool comprises a first spool end, a second spool end, and a spool body between the first spool end and the second spool end, the spool body being rotatable about a rotational axis, wherein the spool is coupled to a line, the line being further wound onto the spool when the spool rotates in a first direction and the line being further unwound from the spool when the spool rotates in a second direction;

generating a rotational data comprising at least the number of spool rotations, wherein the rotational data is gathered from a rotational detection system comprising a sensor module and one or more sensing targets, the sensor module being disposed across from and facing the one or more sensing targets at a certain distance, the one or more sensing targets being disposed at even intervals around a perimeter of the first spool end and extending from the perimeter of the first spool end inwardly towards the rotational axis, wherein the one or more sensing targets pass in front of the sensor module when the spool rotates; and determining at least one of a length, position, and velocity of an unwound portion of the line from the rotational data, wherein the length of an unwound portion of the line is measured only from the rotational data and is based at least partially on the number of spool rotations, the diameter of the spool, the diameter of the line, the number of wraps per layer of line on the spool, and the number of wraps beyond the last full layer of cable, thereby compensating for decreasing length of line per layer of line on the spool.

8. The spooling control method of claim 7, wherein the rotational data comprises number of revolutions, speed of revolution, direction of revolution, or any combination thereof.

9. The spooling control method of claim 8, further comprising:

determining a measured relationship between the length of the unwound portion of the line and the number of revolutions of the spool; and deriving a simplified algorithm relating an estimated length of the unwound portion of the line and the number of revolutions of the spool from the measured relationship.

10. The spooling control method of claim 7, further comprising:

emitting an indication signal when the length of the unwound portion of the line is greater than or less than a threshold value, wherein the indication signal comprises a visual indication, an audible indication, a signal to a remote device, or any combination thereof.

11. The spooling control method of claim 7, further comprising:

emitting a control signal when the length of the unwound portion of the line is greater than or less than a threshold value, wherein the control signal changes at least one operational aspect of the spool.

12. The spooling control method of claim 11, wherein the control signal slows down the speed of rotation of the spool, limits the speed of rotation of the spool, stops rotation of the spool, or any combination thereof.

13. A spooling system, comprising:

a spool comprising a first spool end, a second spool end, and a spool body between the first spool end and the second spool end, the spool body being rotatable about a rotational axis;

a line comprising a first end and a second end, the first end coupled to the spool body and the second end coupled to a tool, wherein at least a portion of the line is wound onto the spool; and a rotational detection system coupled to the spool, a spool holder that is coupled to the spool, or both, wherein the rotational detection system detects rotation of the spool and outputs data regarding the number of revolutions made by the spool, wherein the rotational detection system comprises a sensor module and one or more sensing targets, the sensor module being disposed across from and facing the one or more sensing targets at a certain distance, the one or more sensing targets being disposed at even intervals around a perimeter of the first spool end and extending from the perimeter of the first spool end inwardly towards the rotational axis, wherein the one or more sensing targets pass in front of the sensor module when the spool rotates, wherein the length of an unwound portion of the line is measured only with data from the rotational detection system and is based at least partially on the number of revolutions made by the spool, the diameter of the spool, the diameter of the line, the number of wraps per layer of line on the spool, and the number of wraps beyond the last full layer of cable, thereby compensating for decreasing length of line per layer of line on the spool.

14. The spooling system of claim 13, wherein the rotational detection system includes an optical encoder, a magnetic encoder, a hall effect sensing system, an inductive proximity sensor, or a combination thereof.

15. The spooling system of claim 13, further comprising a controller, wherein the controller receives a signal from the rotational detection system indicative of the number of revolutions made by the spool and determines a position or distance of the tool based on the number of revolutions made by the spool.

16. The spooling control method of claim 15, further comprising:

emitting an indication signal or a control signal when the position or distance of the tool is greater than or less than a depth threshold value, and/or when a detected velocity of the spool is above or below a velocity threshold value.

17. The spooling control method of claim 16, wherein the indication signal comprises a visual indication, an audible indication, a signal to a remote device, or any combination thereof, and wherein the control signal changes at least one operational aspect of the spool.

18. The spooling control method of claim 15, wherein the control signal slows down the speed of rotation of the spool, limits the speed of rotation of the spool, stops rotation of the spool, or any combination thereof.

19. The spooling control method of claim 13, wherein the rotational detection system comprises an inductive proximity sensing system, the inductive proximity sensing system further comprising the sensor module and the one or more sensing targets.

* * * * *